US009221567B2

(12) United States Patent
Vick et al.

(10) Patent No.: US 9,221,567 B2
(45) Date of Patent: Dec. 29, 2015

(54) SYSTEMS, METHODS, AND DEVICES FOR TENSIONING STRAPS

(71) Applicant: SOUTHERN BRACING SYSTEMS ENTERPRISES, LLC, Armuchee, GA (US)

(72) Inventors: Wayne E. Vick, Armuchee, GA (US); David W. Vick, Armuchee, GA (US); Clayton D. Vick, Rome, GA (US); Joseph David Hawks, Powder Springs, GA (US); Eddie R. Shockley, Kingston, GA (US)

(73) Assignee: Southern Bracing Systems Enterprises, LLC, Armuchee, GA (US)

( * ) Notice: Subject to any disclaimer, the term of this patent is extended or adjusted under 35 U.S.C. 154(b) by 408 days.

(21) Appl. No.: 13/750,388

(22) Filed: Jan. 25, 2013

(65) Prior Publication Data

US 2013/0186287 A1 Jul. 25, 2013

Related U.S. Application Data

(60) Provisional application No. 61/590,517, filed on Jan. 25, 2012.

(51) Int. Cl.

| | |
|---|---|
| ***B65B 13/22*** | (2006.01) |
| ***B65B 13/18*** | (2006.01) |
| ***B65B 13/02*** | (2006.01) |

(52) U.S. Cl.

CPC ..... *B65B 13/22* (2013.01); *B65B 13/025* (2013.01); *B65B 13/185* (2013.01)

(58) Field of Classification Search

CPC .... B65B 13/185; B65B 13/22; B65B 13/025; B65B 13/305; B21F 9/02

USPC ..... 100/29, 32; 140/93.2, 93.4, 123.5, 150, 140/152; 53/582, 592; 156/494, 496; 254/216, 218, 230, 243; 242/395, 396, 242/396.4, 410

See application file for complete search history.

(56) References Cited

U.S. PATENT DOCUMENTS

| | | | | |
|---|---|---|---|---|
| 1,665,323 A | | 4/1928 | Payne | |
| 1,939,746 A | * | 12/1933 | Whitman | 254/213 |
| 1,989,669 A | | 2/1935 | Harvey | |
| 2,102,981 A | | 12/1937 | Spencer | |
| 2,113,757 A | | 4/1938 | Bietso et al. | |

(Continued)

FOREIGN PATENT DOCUMENTS

| | | |
|---|---|---|
| CH | 629719 | 5/1982 |
| GB | 1598175 | 9/1981 |

(Continued)

*Primary Examiner* — Jimmy T Nguyen

(74) *Attorney, Agent, or Firm* — Kilpatrick Townsend & Stockton LLP

(57) ABSTRACT

Tensioning devices include a base housing with a drive gear, a spindle gear proximate the drive gear, and a pawl proximate the spindle gear; a lever pivotally coupled to the base housing and a lug pivotally coupled to the lever, wherein the lug is configured to interact with the drive gear; a spindle fixedly coupled to the spindle gear; and a brake assembly coupled to the base housing, wherein, the lug is configured to avoid engagement with the drive gear when the lever is rotated in a first direction, but configured to engage the drive gear when the lever is rotated in a second direction, so as to effect rotation of the drive gear in the second direction, and thereby effect a counter rotation of the spindle gear and spindle.

13 Claims, 9 Drawing Sheets

(56) References Cited

U.S. PATENT DOCUMENTS

| | | | | |
|---|---|---|---|---|
| 2,182,004 | A | 12/1939 | Spencer | |
| 2,199,744 | A | 5/1940 | Gerrard | |
| 2,210,510 | A * | 8/1940 | Sutton | 140/93.2 |
| 2,298,658 | A | 10/1942 | Spencer | |
| 2,336,264 | A | 12/1943 | Leslie | |
| 2,368,969 | A | 2/1945 | Cleveland | |
| 2,375,769 | A | 5/1945 | Childress et al. | |
| 2,560,456 | A | 7/1951 | Kuoni | |
| 2,600,224 | A | 6/1952 | Dunbar | |
| 2,621,893 | A | 12/1952 | Childress | |
| 2,661,030 | A | 12/1953 | Crosby et al. | |
| 2,751,939 | A | 6/1956 | Barker | |
| 2,777,344 | A | 1/1957 | Smith | |
| 2,813,441 | A | 11/1957 | Borbee et al. | |
| 2,868,238 | A | 1/1959 | Hall | |
| 2,982,069 | A | 5/1961 | England | |
| 3,013,589 | A | 12/1961 | Jones | |
| 3,021,876 | A | 2/1962 | Hall et al. | |
| 3,114,399 | A | 12/1963 | Hamilton et al. | |
| 3,129,728 | A | 4/1964 | Sharko | |
| 3,164,372 | A | 1/1965 | Derrickson | |
| 3,205,916 | A | 9/1965 | Willis | |
| 3,241,579 | A | 3/1966 | Partridge | |
| 3,309,061 | A | 3/1967 | Plattner | |
| 3,333,608 | A | 8/1967 | Kuoni | |
| 3,380,485 | A | 4/1968 | Plattner et al. | |
| 3,572,398 | A | 3/1971 | Sansum | |
| 3,605,823 | A | 9/1971 | Fromm | |
| 3,650,301 | A | 3/1972 | Karass | |
| 3,837,373 | A | 9/1974 | Beardsley | |
| 3,844,317 | A | 10/1974 | Angarola et al. | |
| 3,858,625 | A | 1/1975 | Banjeglav | |
| 3,944,460 | A | 3/1976 | Karr | |
| 3,998,429 | A | 12/1976 | Cheung | |
| 4,015,643 | A | 4/1977 | Cheung | |
| 4,063,985 | A | 12/1977 | Kyts | |
| 4,252,158 | A | 2/1981 | McDade | |
| 4,289,174 | A | 9/1981 | Massion | |
| 2,638,314 | A | 5/1983 | McFerren et al. | |
| 4,574,848 | A | 3/1986 | Bartzick et al. | |
| 4,934,261 | A * | 6/1990 | Niedrig | 100/32 |
| 5,029,433 | A | 7/1991 | Werk | |
| 5,058,365 | A | 10/1991 | Kagi | |
| 5,181,546 | A | 1/1993 | Synek | |
| 5,203,541 | A | 4/1993 | Nix | |
| 5,392,821 | A | 2/1995 | Chudy | |
| 6,152,188 | A | 11/2000 | Barlasov | |
| 6,554,030 | B2 | 4/2003 | Cheung et al. | |
| 6,640,838 | B2 | 11/2003 | Finzo | |
| 6,698,460 | B2 | 3/2004 | Marsche | |
| 6,729,357 | B2 | 5/2004 | Marsche | |
| 6,772,798 | B2 | 8/2004 | Cheung | |
| 6,981,528 | B2 | 1/2006 | Bartholomew | |
| 7,128,099 | B2 | 10/2006 | Finzo | |
| 7,331,165 | B1 | 2/2008 | Yu et al. | |
| 7,350,543 | B2 | 4/2008 | Crittenden | |
| 7,455,080 | B2 | 11/2008 | Crittenden et al. | |
| 2009/0158942 | A1 * | 6/2009 | Barlosov et al. | 100/6 |
| 2010/0132827 | A1 | 6/2010 | Yu Chen | |

FOREIGN PATENT DOCUMENTS

| | | |
|---|---|---|
| JP | 07165211 | 6/1995 |
| TW | 424748 | 3/2001 |

* cited by examiner

SYSTEMS, METHODS, AND DEVICES FOR TENSIONING STRAPS

CROSS REFERENCE TO RELATED APPLICATIONS

This application is related to and claims priority benefits from U.S. Provisional Application Ser. No. 61/590,517, filed on Jan. 25, 2012, entitled "SYSTEMS, METHOD, AND DEVICE FOR TENSIONING STRAPS" ("the '517 application"). The '517 application is hereby incorporated in its entirety by this reference.

FIELD OF THE INVENTION

The field of the invention relates to the tensioning of straps and the like.

BACKGROUND

Existing methods and devices for tensioning straps are often inefficient, non-ergonomic, too complex, otherwise undesirable, and problematic. Such methods and devices fail to produce optimal tensioning and may also cause slips, binds, or breaks of the strap to be tensioned. Thus, it may be desirable to provide a strap tensioning device that may provide a higher tensioning value when loads are initially tensioned and/or without damaging the strap during the tensioning process.

Additionally, in some cases, loads may shift or otherwise lose tension prior to or during transport. In these cases, it may be necessary to re-tension the load. Conventional tensioning devices are often unable to re-tension straps in cases where the straps are already under some tension because a certain amount of inherent slack may be required in the straps for the tensioning device to properly operate. In the absence of such slack, these conventional tensioning devices are typically unable to grip or secure the strap for tensioning. As a result, these conventional tensioning devices typically ride up the strap during attempts to tension the strap, rather than actually tension the strap. Thus, it may be desirable to provide a strap tensioning device that may be able to re-tension a load to a desired tensioning value when the straps are already under some amount of tension load.

Additionally, in some cases, tensioning devices are also configured to release some of the tension in the strap when the strap tensioning device is removed from the strap. Often, with conventional tensioning devices, the amount of tension loss is unacceptable because the strap tension has dropped below minimum standards or the load becomes too loose for transport. Thus, it may be desirable to provide a strap tensioning device that may be able to be removed from the strap, while avoiding a tension release that would generate a remaining tension value that does not meet minimum standards and/or a load that is too loose for transport.

Additionally, conventional tensioning devices are often configured for use with particular strap sizes and thicknesses, so that a specific strap tensioning device is needed for each strap size and/or thickness. Thus, it may be desirable to provide a universal strap tensioning device for use with different types and sizes of strap.

SUMMARY

Certain embodiments of the present invention include a tensioning device comprising: a base housing comprising: a drive gear, a spindle gear proximate the drive gear, and a pawl proximate the spindle gear; a lever pivotally coupled to the base housing and comprising a lug pivotally coupled to the lever, wherein the lug is configured to interact with the drive gear; a spindle fixedly coupled to the spindle gear; and a brake assembly coupled to the base housing, wherein, the lug is configured to avoid engagement with the drive gear when the lever is rotated in a first direction, but configured to engage the drive gear when the lever is rotated in a second direction, so as to effect rotation of the drive gear in the second direction, thereby effecting a counter rotation of the spindle gear and spindle.

In some embodiments, the spindle comprises a slot. In some embodiments, the pawl is configured to limit rotation of the spindle gear absent rotation of the drive gear in the second direction. In some embodiments, the brake assembly is configured to operate independently from the lever. In some embodiments, the brake assembly comprises a biasing mechanism. In some embodiments, the tensioning device further comprises a support handle. In some embodiments, the tensioning device further comprises a guide.

Certain embodiments of the present invention also include a method for tensioning a strap with a tensioning device, such as the above-described device, the method steps comprising: securing the strap about a load with a buckle mechanism; securing the strap via the brake assembly; coupling a free end of the strap downstream from the buckle mechanism to the spindle; rotating the lever in a first direction away from the load, wherein the lug does not engage the drive gear; and rotating the lever in a second direction toward the load, wherein the lug engages the drive gear and rotates the drive gear in the second direction, wherein the drive gear engages the spindle gear and rotates the spindle gear, and thereby the spindle, in a counter direction, thereby tensioning the strap.

Certain embodiments of the present invention also include a method for removing the free end of a strap from a tensioning device, such as the above-described device, after tensioning of the strap about a load, the method steps comprising: first, engaging the lever with the drive gear; second, displacing the pawl from proximate the spindle gear; third, rotating the lever a first direction away from the load, wherein the drive gear engages the spindle gear and rotates the spindle gear, and thereby the spindle, in a counter direction, releasing the tension on the free end of the strap; and fourth, decoupling the free end of the strap from the spindle.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

Illustrative embodiments of the present invention are described in detail below with reference to the following drawing figures.

DETAILED DESCRIPTION

Figure 1:
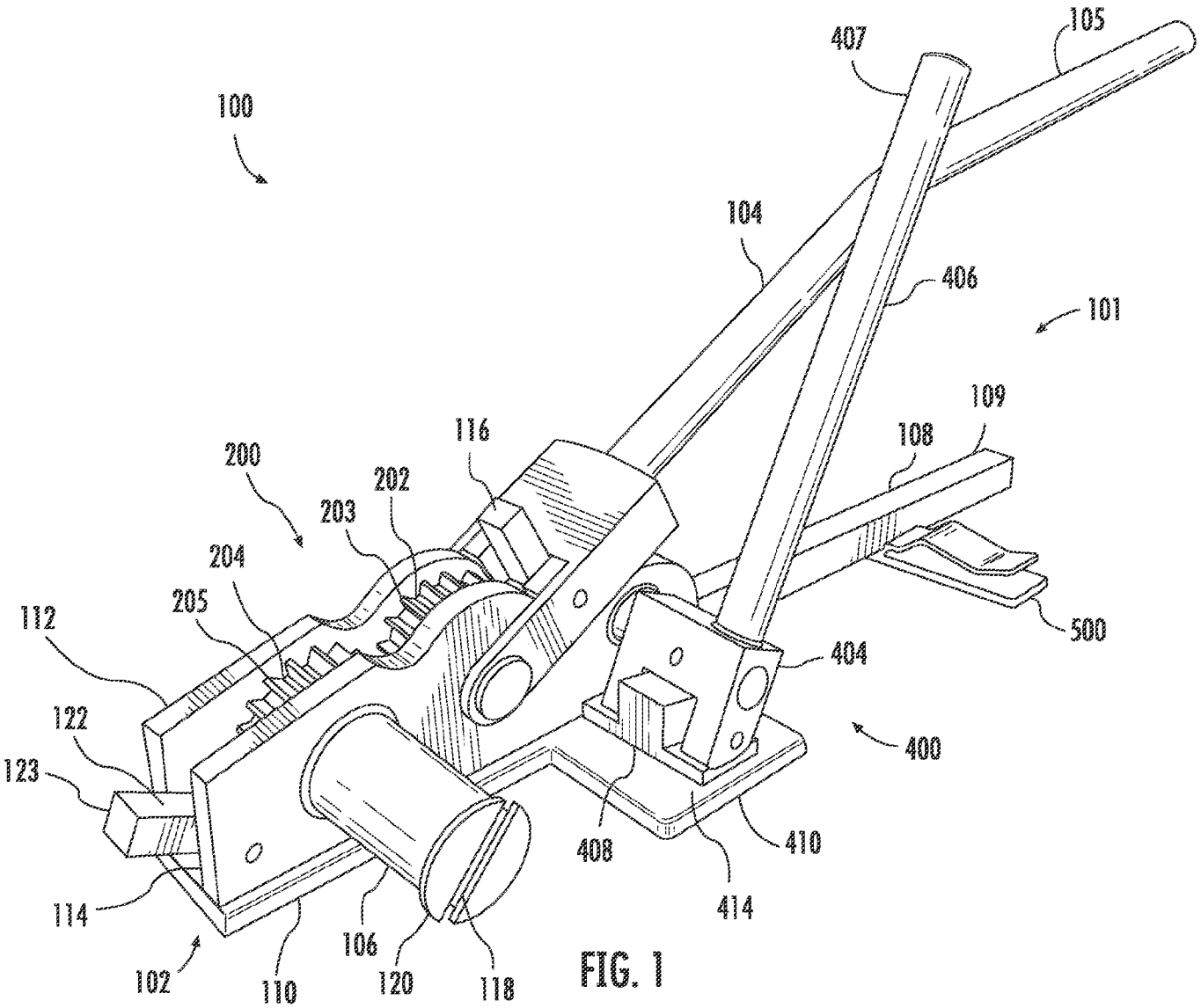
FIG. 1 is a perspective view of a tensioning device according to certain embodiments of the present invention.
Figure 2:
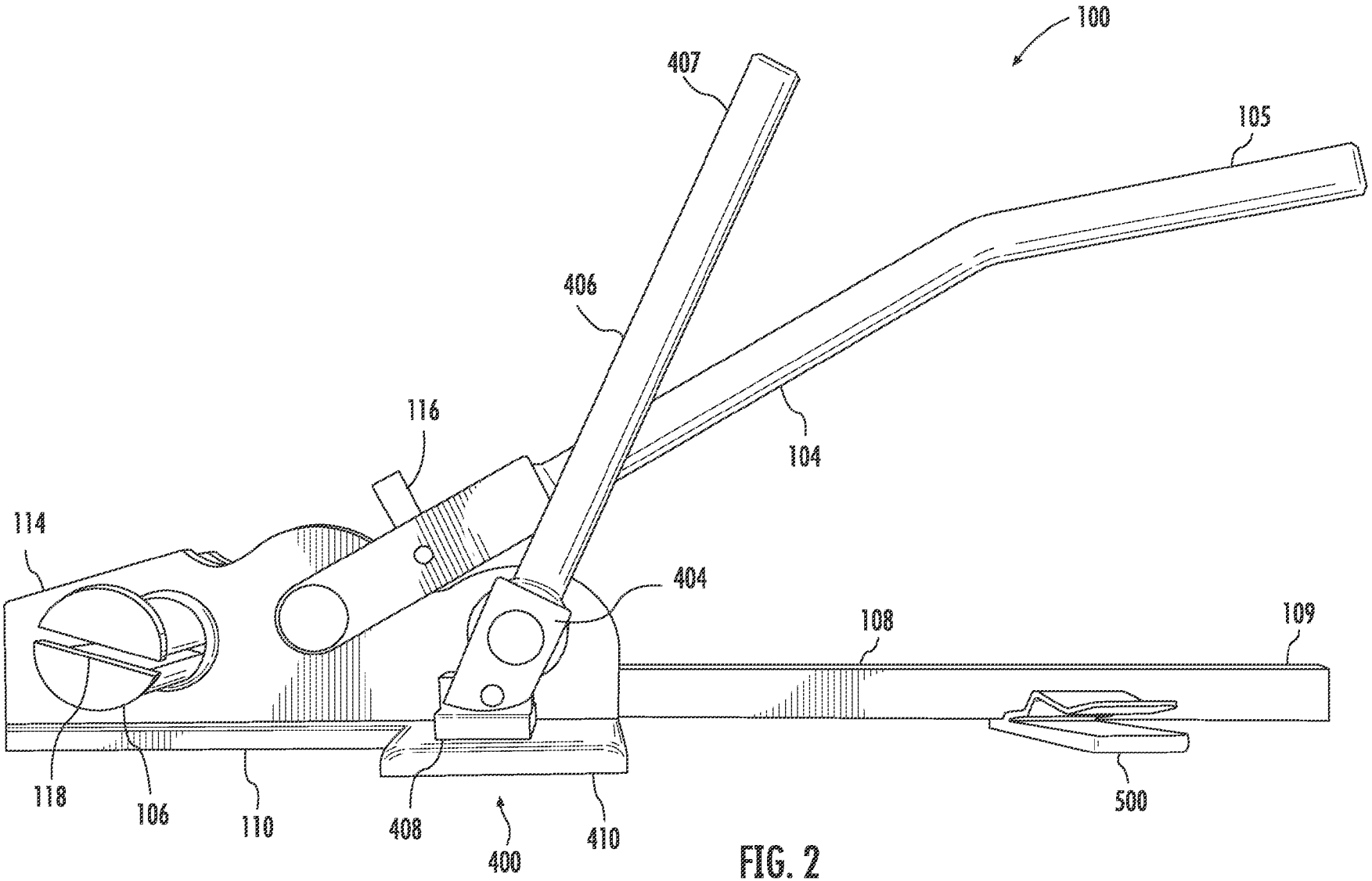
FIG. 2 is a side perspective view of the tensioning device of FIG. 1.
Figure 3:
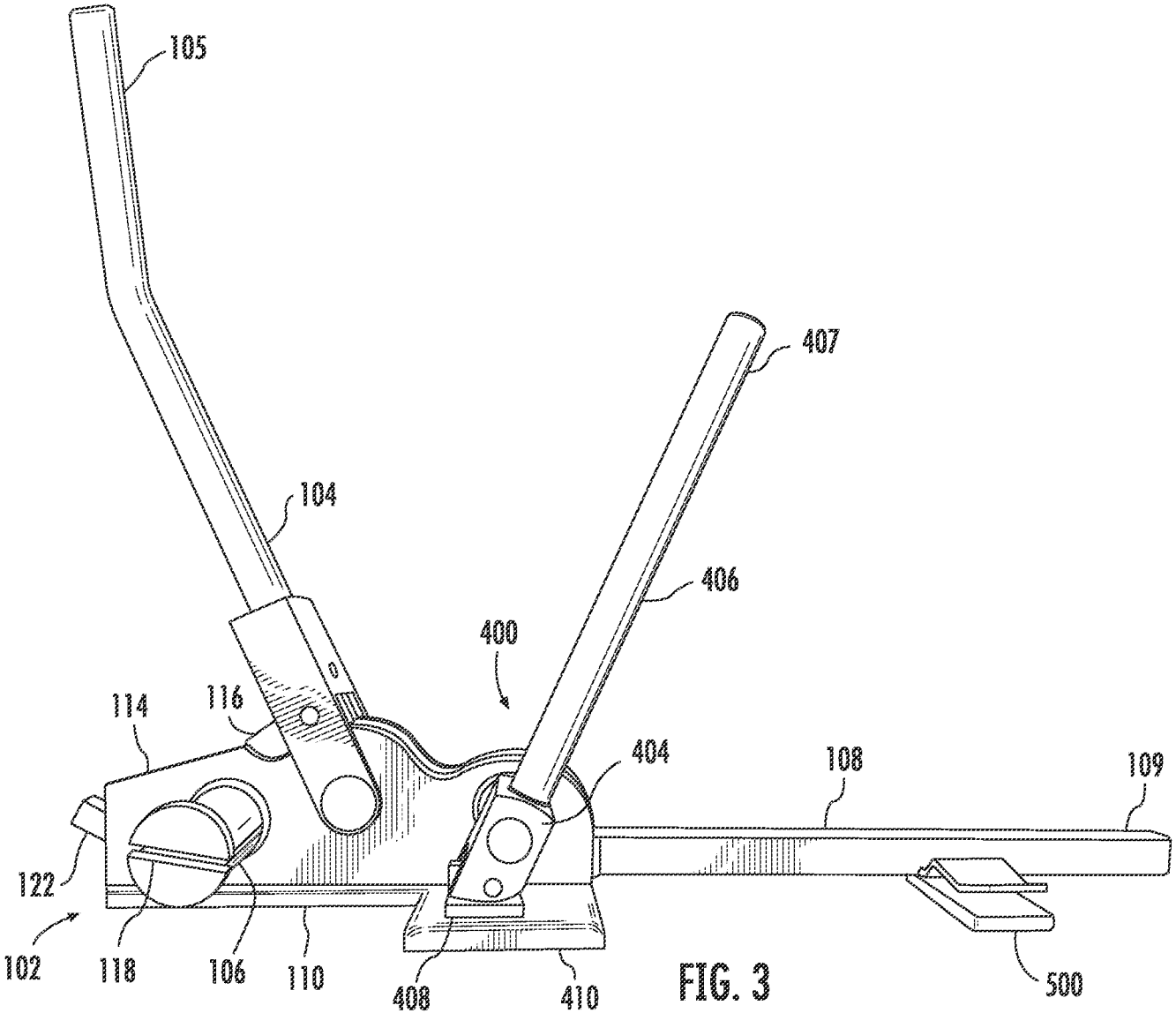
FIG. 3 is a side perspective view of the tensioning device of FIG. 1, wherein the lever handle is in a raised position.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention provide tensioning devices configured to tighten or tension straps around a load or object. For example, the tensioning devices may be used to tension a non-woven polyester strap, which may be configured to minimize or eliminate elongation, around a load or object. The tensioning devices may also be configured for universally tensioning straps of various sizes, including but not limited to a ¾ inch strap, a 1¼ inch strap, and a 2 inch strap, via the "open-ended" design illustrated in FIGS. 1-8. While the tensioning devices are generally discussed for use with straps, they are by no means so limited. Rather, embodiments of the tensioning devices may be used in connection with any strapping or similar securing means.

FIGS. 1-8 illustrate embodiments of a tensioning device 100. In these embodiments, the tensioning device 100 comprises a base housing 102, a lever 104, a spindle 106, and a support handle 108. The base housing 102 may comprise a set of gears 200, including a drive gear 202 and a spindle gear 204, and corresponding shafts 300, including a drive shaft 302 and spindle shaft 304. In some embodiments, such as the embodiments illustrated in FIG. 1-8, the tensioning device 100 may also comprise a brake assembly 400. In some embodiments, such as the embodiments illustrated in FIG. 1-8, the tensioning device 100 may also comprise a guide 500.

Figure 4:
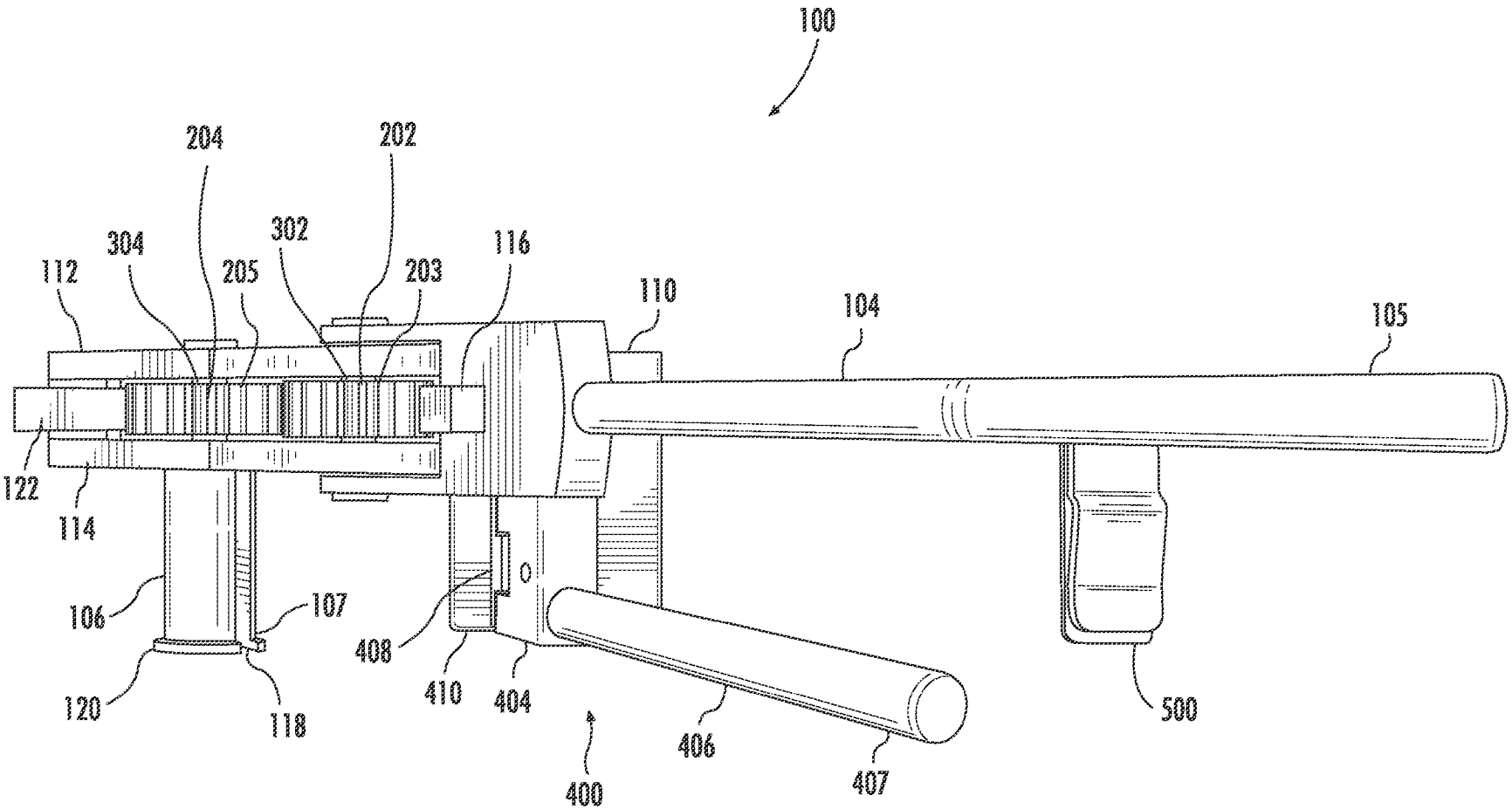
FIG. 4 is a top perspective view of the tensioning device of FIG. 1.
Figure 5:
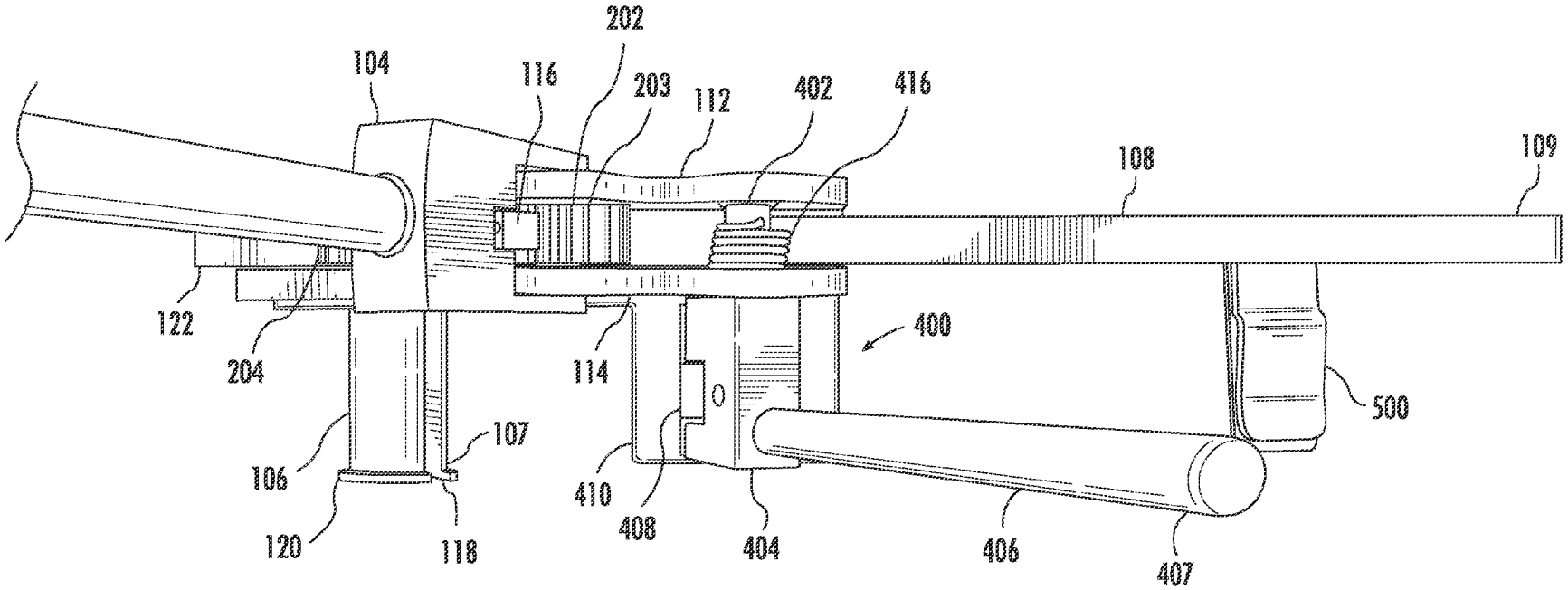
FIG. 5 is a top perspective view of the tensioning device of FIG. 1, wherein the lever handle is in a raised position.
Figure 6:
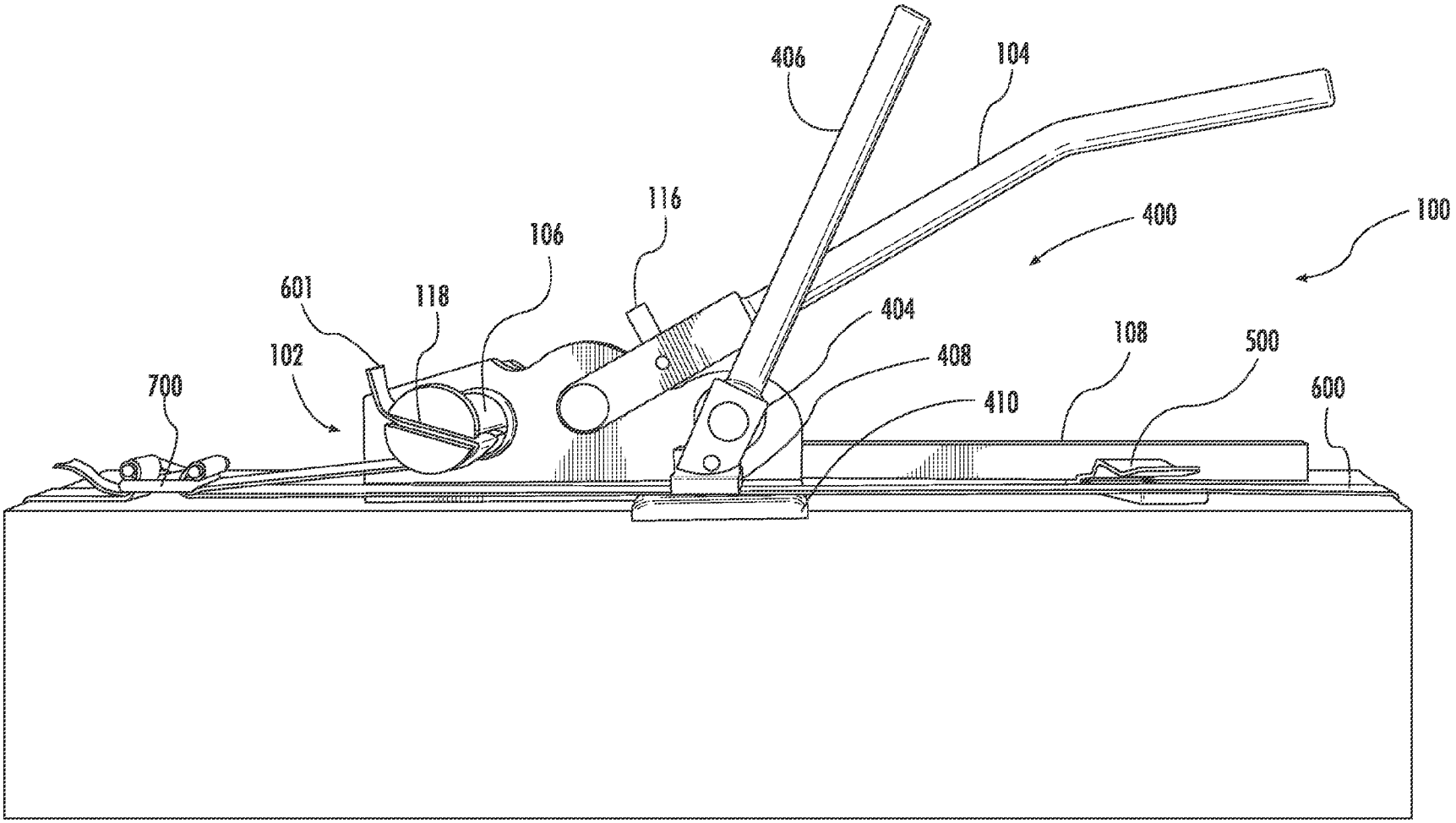
FIG. 6 is a side perspective view of the tensioning device of FIG. 1 in combination with a strap about an object.

The base housing 102, as illustrated in FIGS. 1-8, provides the foundation of the tensioning device 100. The base housing 102 may be formed of materials including but not limited to plastics, composite plastics, steel, other metallic materials, composite materials, or other similar materials. In some embodiments, such as the embodiments illustrated in FIGS. 1-8, the base housing 102 may be formed of two or more parts, such as a bottom plate 110, and side plates 112 and 114. In these embodiments, the parts may be coupled together by a variety of mechanisms, including but not limited to an adhesive, bolts, fasteners, screws, welding, and other coupling mechanisms. In other embodiments, the base housing 102 may be integrally formed. Throughout embodiments, the dimensions of the base housing 102 may vary as needed. For example, in some embodiments, such as the embodiments illustrated in FIGS. 1-8, the bottom plate 110 of the base housing 102 may include a flat surface (not pictured) configured to interface with the load or object about which the strap 600 is being tensioned, as illustrated in FIG. 6.

As illustrated in FIGS. 1 and 4, the base housing 102 houses the set of gears 200 and corresponding shafts 300. The drive gear 202 is rotatably coupled to the base housing 102 by the drive shaft 302. In some embodiments, the drive gear 202 may be fixedly coupled to the drive shaft 302. As a result, rotation of the drive gear 202 may induce a corresponding rotation of the drive shaft 302, and vice versa. The drive gear 202 is positioned within the base housing 102 proximate the spindle gear 204, such that teeth 203 of the drive gear 202 may interact with teeth 205 of the spindle gear 204. The drive gear 202 may be formed of materials including but not limited to plastics, composite plastics, steel, other metallic materials, composite materials, or other similar materials.

The spindle gear 204 is rotatably coupled to the base housing 102 by the spindle shaft 304. In some embodiments, the spindle gear 204 may be fixedly coupled to the spindle shaft 304. As a result, rotation of the spindle gear 204 may induce a corresponding rotation of the spindle shaft 304, and vice versa. The spindle gear 204 is positioned within the base housing 102 proximate the drive gear 202, such that the teeth 205 of the spindle gear 204 may interact with the teeth 203 of the drive gear 202. The spindle gear 204 may be formed of materials including but not limited to plastics, composite plastics, steel, other metallic materials, composite materials, or other similar materials.

In some embodiments, the gears 200 may be configured to minimize the spacing between teeth 203 and 205. Such configurations minimize or eliminate any otherwise limited amount of potential backward motion of the gears 200, commonly referred as "backlash."

The lever 104 is configured to control the drive gear 202, and thereby the tensioning process. In these embodiments, the lever 104 may be rotatably coupled to the base housing 102, allowing the lever 104 to achieve a number of raised positions relative to the base housing 102, as illustrated for example in FIGS. 3, 5, and 7. In the embodiments illustrated in FIGS. 1-8, the lever 104 is rotatably coupled to the base housing 102 by the drive shaft 302. One of ordinary skill in the relevant art, however, will understand that the lever 104 may be rotatably coupled to the base housing 102 by a variety of other mechanisms, including but not limited to pins, hinges, and other coupling mechanisms. The lever 104 may be formed of materials including but not limited to plastics, composite plastics, steel, other metallic materials, composite materials, or other similar materials. In some embodiments, the lever 104 may be formed of two or more parts. In these embodiments, the parts may be coupled together by a variety of mechanisms, including but not limited to an adhesive, bolts, fasteners, screws, welding, and other coupling mechanisms. In other embodiments, the lever 104 may be integrally formed. Throughout embodiments, the dimensions of the lever 104 may vary as needed. For example, in some embodiments, such as the embodiments illustrated in FIGS. 1-8, the lever 104 may have an elongated shape. In some embodiments, a distal end 105 of the lever 104 may comprise a rubber grip or similar material to contribute to the ease of use of the device 100.

In some embodiments, such as the embodiments illustrated in FIGS. 1-8, the lever 104 may comprise a lug 116 positioned and configured to selectively contact the teeth 203 of the drive gear 202. In some embodiments, the lug 116 may be pivotally coupled to the lever 104 by a variety of mechanisms, including but not limited to shafts, pins, hinges, and other coupling mechanisms. In some embodiments, the lug 116 may be similar to a pawl in a ratchet device, and be configured to selectively interact with teeth 203 of the drive gear 202, as illustrated for example in FIGS. 5 and 9. In these embodiments, the lug 116 may be configured to engage a tooth 203 of the drive gear 202 so as to rotate the drive gear 202 in a certain direction when the lever 104 is rotated in the same certain direction, but avoid engagement with a tooth 203 of the drive gear 202 when the lever is rotated in an alternative direction. For example, in the embodiments illustrated in FIGS. 1-8, the lug 116 is configured to engage a tooth 203 of the drive gear 202 so as to rotate the drive gear 202 in a clockwise direction when the lever 104 is pulled in a clockwise direction, toward the support handle 108. Conversely, in the embodiments illustrated in FIGS. 1-8, the lug 116 is configured to not engage any teeth 203 of the drive gear 202, but rather slide up and over the teeth 203, when the lever 104 is moved in a counter-clockwise direction, away from the support handle 108 (e.g., raised to a reset position). In some embodiments, the lug 116 may be spring-loaded. The lug 116 may be formed of materials including but not limited to plastics, composite plastics, steel, other metallic materials, composite materials, or other similar materials. The dimensions of the lug 116 may vary throughout embodiments, and, in particular, may vary based on the dimensions of the drive gear 202 and its teeth 203.

The spindle 106 is configured to secure a free end 601 of the strap 600 for tensioning and collect any excess strapping during the tensioning process. In some embodiments, the spindle 106 may be rotatably coupled to the base housing 102. In some embodiments, the spindle 106 may be fixedly coupled to the spindle gear 204. As a result, rotation of the spindle gear 204 may induce a corresponding rotation of the spindle 106. In some embodiments, such as the embodiments illustrated in FIGS. 1-8, the spindle 106 may be fixedly coupled to the spindle gear 204 by the spindle shaft 304. As a result, rotation of the spindle shaft 304 may induce a corresponding rotation of the spindle 106. The spindle 106 may be formed of materials including but not limited to plastics, composite plastics, steel, other metallic materials, composite materials, or other similar materials. Throughout embodiments, the dimensions of the spindle 106 may vary as needed. For example, in some embodiments, the spindle 106 may have a cylindrical shape, as illustrated in FIGS. 1-8, extending outward from the base housing 102. In these embodiments, the height of the spindle 106 extending outward from the base housing 102 may vary throughout the embodiments. For example, in some embodiments, the height of the spindle 106 is greater than or equal to the width of the strap 600 sought to be tensioned.

In some embodiments, such as the embodiments illustrated in FIGS. 1-8, the spindle 106 may comprise a slot 118. The slot 118 may be configured to accept a portion of the strap 600 within the spindle 106 to facilitate the tensioning process, and facilitate the collection of excess strapping about the spindle 106 during the tensioning process. As illustrated in the embodiments shown in FIGS. 1-8, the slot 118 may extend through a cross-sectional diameter or chord of the spindle 106. In these embodiments, the slot 118 may comprise an "open-ended" design, as illustrated for example in FIG. 1, such that straps 600 of various widths may be housed within the slot 118 during the tensioning process. The depth of the slot 118 within the spindle 106 may vary throughout embodiments, and, in particular, may vary based on the width of the strap 600 to be tensioned. The width of the slot 118 may also vary throughout embodiments, and, in particular, may vary based on the thickness of the strap 600 to be tensioned.

In some embodiments, such as the embodiments illustrated in FIGS. 1-8, the spindle 106 may comprise an outer rim 120. In these embodiments, the outer rim 120 may assist in the collection of excess strapping about the spindle 106 during the tensioning process, and maintain the strapping about the spindle 106 during the tensioning process. In these embodiments, the outer rim 120 may extend around the circumference of a distal end 107 of the spindle 106, as illustrated in FIGS. 1-8.

Contrary to some existing tensioning devices, no footer or similar apparatus is required in correlation with the spindle 106. Such a footer or similar apparatus may limit the potential number of winds of the spindle 106, thereby limiting the utility of the tensioning device 100. One of ordinary skill in the art, however, will understand that a footer or other similar apparatus may be included in certain embodiments as needed or desired to achieve the desired tensioning result.

In some embodiments, the base housing 102 may also comprise a pawl 122, which may limit the rotation of the spindle gear 204, akin to a ratchet device. As illustrated in FIGS. 1-9, the pawl 122 may be positioned and configured to selectively contact the teeth 205 of the spindle gear 204. In these embodiments, the pawl 122 may be configured to slide up and over the teeth 205 of the spindle gear 204 when the spindle gear 204 is rotated in a first direction. When the spindle gear 204 is rotated in a second direction (or attempt to be so rotated), however, the pawl 122 may be configured to catch against the edge of the first tooth 205 it encounters, thereby locking it against the tooth 205 and preventing any further rotation of the spindle gear 204 in that direction. For example, in the embodiments illustrated in FIGS. 1-9, the pawl 122 may be configured to slide up and over the teeth 205 of the spindle gear 204 when the spindle gear 204 is rotated in a counter-clockwise direction. When the spindle gear 204 is rotated in a clockwise direction (or attempt to be so rotated), however, the pawl 122 may be configured to catch against the edge of the first tooth 205 it encounters, thereby locking it against the tooth 205 and preventing any further rotation of the spindle gear 204 in that direction. In these embodiments, the pawl 122 may be pivotally coupled to the base housing 102 by a variety of mechanisms, including but not limited to shafts, pins, hinges, and other coupling mechanisms. In some embodiments, the pawl 122 may be spring-loaded. The pawl 122 may be formed of materials including but not limited to plastics, composite plastics, steel, other metallic materials, composite materials, or other similar materials.

In some embodiments, the pawl 122 may be capable of being released so as to permit rotation of the spindle gear 204 in both a first and second direction in limited circumstances. For example, in the embodiments illustrated in FIGS. 1-9, the pawl 122 may be capable of being released so as to permit intentional clockwise rotation of the spindle gear 204. In these embodiments, a direct, upward force may be applied to a distal end 123 of the pawl 122 to displace the pawl 122 from contact with the teeth 205 of the spindle gear 204.

The support handle 108 may extend toward a rear 101 of the tensioning device 100 and may contribute to the ease of use of the device 100. For example, in some embodiments, the support handle 108 may facilitate carrying and/or positioning of the tensioning device 100. The support handle 108 may be coupled to the base housing 102. In some embodiments, such as the embodiments illustrated in FIGS. 1-8, the support handle 108 may be coupled to the base housing 102 by a variety of mechanisms, including but not limited to an adhesive, bolts, fasteners, screws, welding, and other coupling mechanisms. In other embodiments, the support handle 108 may be integrally formed with the base housing 102. In some embodiments, the support handle 108 may be fixedly coupled to the base housing 102. The support handle 108 may be formed of materials including but not limited to plastics, composite plastics, steel, other metallic materials, composite materials, or other similar materials. Throughout embodiments, the dimensions of the support handle 108 may vary as needed. For example, in some embodiments, the support handle 108 may have an elongated shape, as illustrated in FIGS. 1-8. In some embodiments, the support handle 108 may include a flat surface (not pictured) configured to interface with the load or object about which the strap 600 is being tensioned, as illustrated in FIG. 6. In some embodiments, a distal end 109 of the support handle 108 may comprise a rubber grip or similar material to contribute to the ease of use of the device 100.

The brake assembly 400 may secure the strap 600 for tensioning. The brake assembly 400 may be coupled to the tensioning device 100, but may operate independent of the balance of the tensioning device 100 (e.g., lever 104), such that the strap 600 may remain secured by the brake assembly 400 during tensioning. As illustrated in FIGS. 1-8, the brake assembly 400 may comprise a brake shaft 402, a body 404 coupled to the brake shaft 402, a brake lever 406 coupled to the body 404, a brake plate 408 coupled to the body 404, and a footer 410. The brake assembly 400 may be formed of materials including but not limited to plastics, composite plastics, steel, other metallic materials, composite materials, or other similar materials. The position of the brake assembly 400 may vary throughout embodiments. For example, in some embodiments, such as the embodiments illustrated in FIG. 6, the brake assembly 400 may be positioned to engage the strap 600 to be tensioned prior to the strap 600 engaging a buckle mechanism 700 about the load or object.

In these embodiments, the body 404 may be rotatably coupled to the base housing 102 by the brake shaft 402. In these embodiments, the body 404 may be fixedly coupled to the brake shaft 402. As a result, rotation of the brake shaft 402 may induce a corresponding rotation of the body 404 (and thereby the brake plate 408), and vice versa. The body 404 may be formed of materials including but not limited to plastics, composite plastics, steel, other metallic materials, composite materials, or other similar materials.

The brake lever 406 may be coupled to the body 404 and may be configured to enable a user to effect rotation of the body 404 and brake shaft 402 about the base housing 102, thereby releasing or engaging the brake plate 408. Throughout embodiments, the dimensions of the brake lever 406 may vary as needed. For example, in some embodiments, the brake lever 406 may have an elongated shape, as illustrated in FIGS. 1-8. In some embodiments, a distal end 407 of the brake lever 406 may comprise a rubber grip or similar material to contribute to the ease of use of the brake assembly 400. In some embodiments, the brake lever 406 may be integrally formed with the body 404. The brake lever 406 may be formed of materials including but not limited to plastics, composite plastics, steel, other metallic materials, composite materials, or other similar materials.

The brake plate 408 may be coupled to the body 404 and may be positioned and configured to secure the strap 600 to be tensioned between the brake plate 408 and the footer 410 of the brake assembly 400, so as to prevent movement of the strap 600. In some embodiments, the brake plate 408 may be integrally formed with the body 404. In other embodiments, such as the embodiments illustrated in FIGS. 1-8, the brake plate 408 may be pivotally coupled to the body 404 to increase its braking power. In some embodiments, the brake plate 408 may be spring-loaded. The brake plate 408 may be formed of materials including but not limited to plastics, composite plastics, steel, other metallic materials, composite materials, or other similar materials. In some embodiments, a contact surface 412 of the brake plate 408 may be textured or otherwise coarse to assist in preventing movement of the strap 600. The shape and dimensions of the brake plate 408 may vary throughout embodiments. For example, in the embodiments illustrated in FIGS. 1-8, the contact surface 412 of the brake plate 408 may have a generally rectangular shape.

The footer 410 may be coupled to the base housing 102 and may extend therefrom to provide a surface 414 underneath the brake plate 408. In some embodiments, the surface 414 may be textured or otherwise coarse to assist in preventing movement of the strap 600. The dimensions of the footer 410 may vary throughout embodiments. For example, in the embodiments illustrated in FIGS. 1-8, the footer 410 is generally rectangular. The position, dimensions, and/or configuration of the footer 410 may also vary based on the thickness of the strap 600 to be tensioned. In some embodiments, the footer 410 may comprise an "open-ended" design, as illustrated in FIG. 1, such that straps 600 of various widths may be secured within the brake assembly 400. In some embodiments, the footer 410 may include a flat surface (not pictured) configured to interface with the load or object about which the strap 600 is being tensioned, as illustrated in FIG. 6. The footer 410 may be formed of materials including but not limited to plastics, composite plastics, steel, other metallic materials, composite materials, or other similar materials.

In some embodiments, such as the embodiments illustrated in FIGS. 1-8, the brake assembly 400, as a whole, may be loaded, so as to increase the braking power of the brake assembly 400. For example, as illustrated in FIG. 5, the brake assembly 400 may comprise a biasing mechanism 416, such as a coil spring, coupled to and about the brake shaft 402. In these embodiments, the brake assembly 400 may provide up to 35 lbs. or more of down pressure to hold the strap 600 in place. In these embodiments, the brake assembly 400 may provide sufficient down pressure to hold a previously tensioned strap 600 in place for any re-tensioning of the strap 600. One of ordinary skill in the relevant art, however, will understand that the brake may be configured to provide any suitable amount of down pressure as needed or desired to achieve the desired tensioning result. In some embodiments, the brake assembly 400 may also be configured such that the brake plate 408 contacts the footer 410 when no strap 600 in contained within the device 100.

In some embodiments, the guide 500 may aid in the securing and/or aligning of the strap 600 for tensioning. As illustrated in FIGS. 1-8, the guide 500 may be configured to accept a portion of the strap 600 to be tensioned so as to align the strap 600 with the balance of the tensioning device 100, and vice versa. In these embodiments, the guide 500 may be coupled to the support handle 108 of the tensioning device 100. The guide 500 may be coupled to the support handle 108 by a variety of mechanisms, including but not limited to an adhesive, bolts, fasteners, screws, welding, and other coupling mechanisms. In some embodiments, the guide 500 may be integrally formed with the support handle 108. The position of the guide 500 along the support handle 108 may vary throughout embodiments. Additionally, in some embodiments, the guide 500 may be releasably coupled to the support handle 108 to allow for adjustment of the position of the guide 500 along the support handle 108. The guide 500 may be formed of materials including but not limited to plastics, composite plastics, steel, other metallic materials, composite materials, or other similar materials. Throughout embodiments, the dimensions of the guide 500 may vary as needed and, in particular, may vary based on the width and/or thickness of the strap 600 to be tensioned. For example, in some embodiments, such as the embodiments illustrated in FIGS. 1-8, the guide 500 may resemble a clip mechanism. In some embodiments, the guide 500 may comprise an "open-ended" design, as illustrated in FIG. 1, such that straps 600 of various widths may be secured within the guide 500.

In use, a strap 600 is first placed around a desired load or object, and secured by the buckle mechanism 700, and possibly tightened by hand, as illustrated by example in FIG. 6. This results in a hand-tightened strap 600 about the load or object and the free end 601 of the strap 600 downstream from the buckle mechanism 700. In these embodiments, a variety of buckle mechanisms 700 may be used in combination with the strap 600, including but not limited to a ladder buckle and a wire buckle.

The free end 601 of the strap 600 may then be coupled to the spindle 106 for tensioning. For example, in the embodiments illustrated in FIGS. 6-8, the free end 601 of the strap 600 may be coupled to the spindle 106 via the slot 118. If applicable, a portion of the hand-tightened strap 600 (i.e., upstream from the buckle mechanism 700) may also be placed along the footer 410 of the brake assembly 400, wherein it may be secured by the brake plate 408, as illustrated by example in FIGS. 6-8. Similarly, if applicable, a portion of the hand-tightened strap 600 (i.e., upstream from the buckle/tie mechanism 700) may also be secured with the guide 500, as illustrated in FIG. 6.

Figure 7:
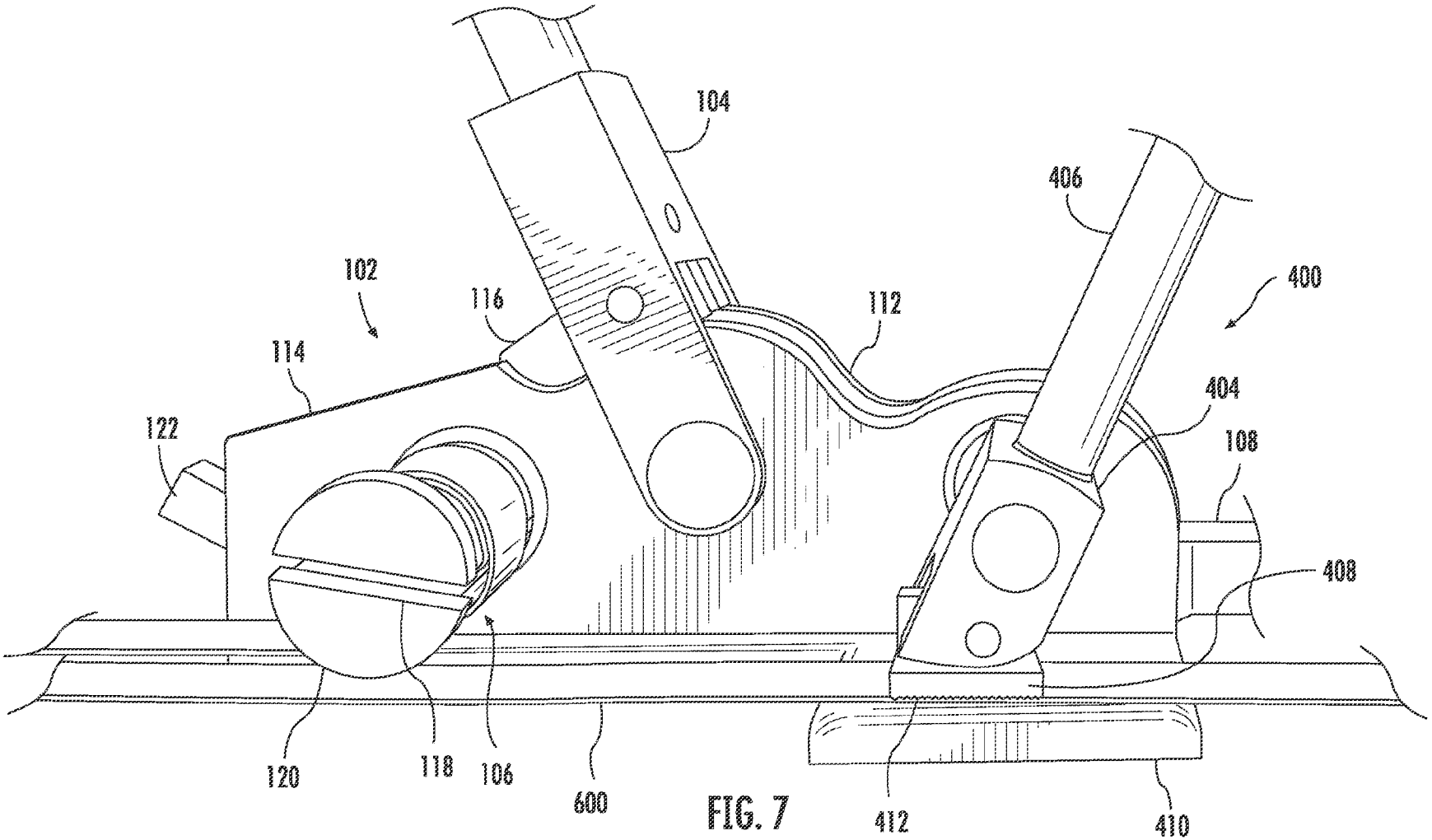
FIG. 7 is a side perspective view of the tensioning device of FIG. 1 in combination with a strap, wherein the lever handle is in a raised position.
Figure 8:
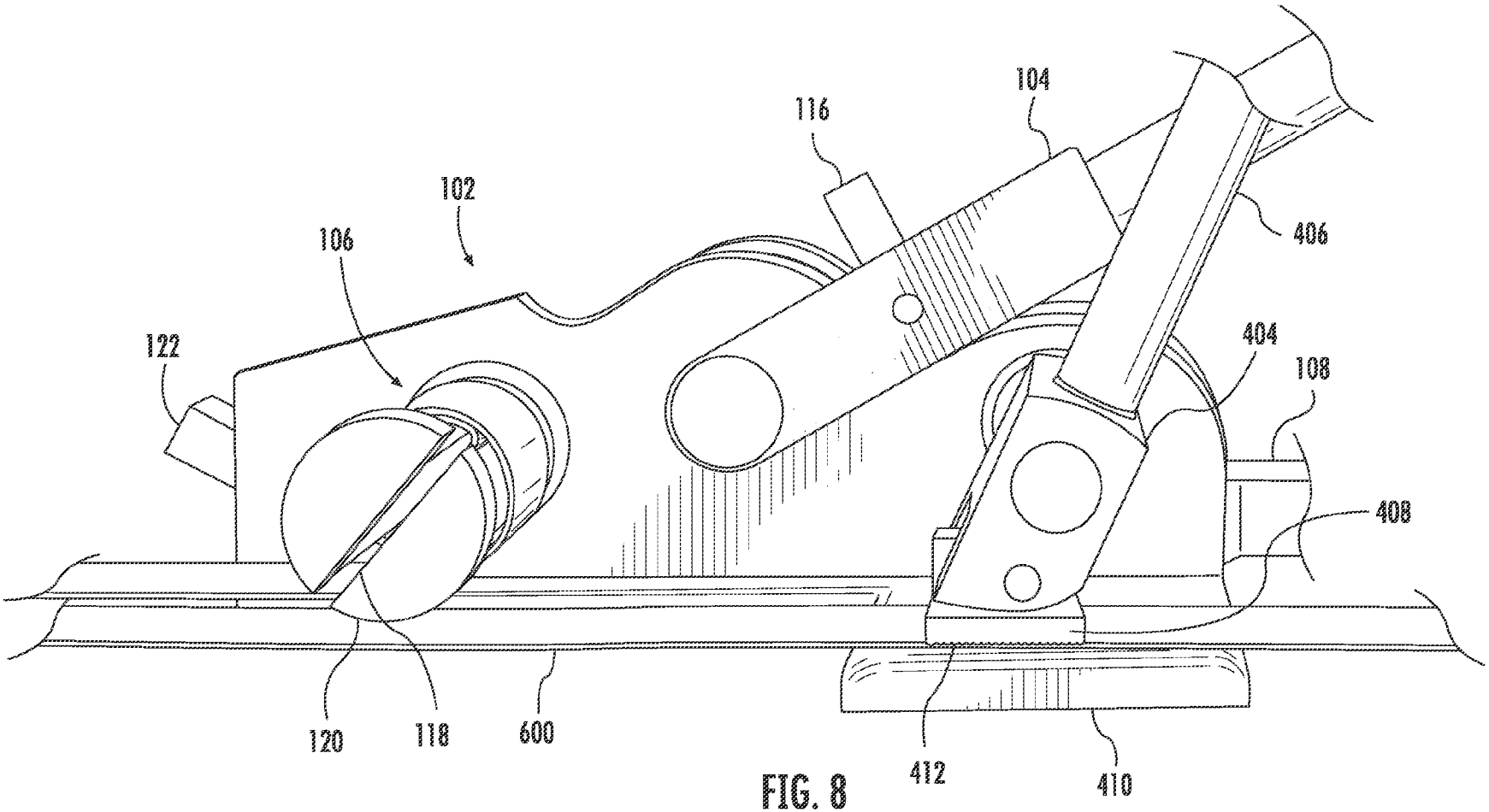
FIG. 8 is a side perspective view of the tensioning device of FIG. 1 in combination with a strap.
Figure 9:
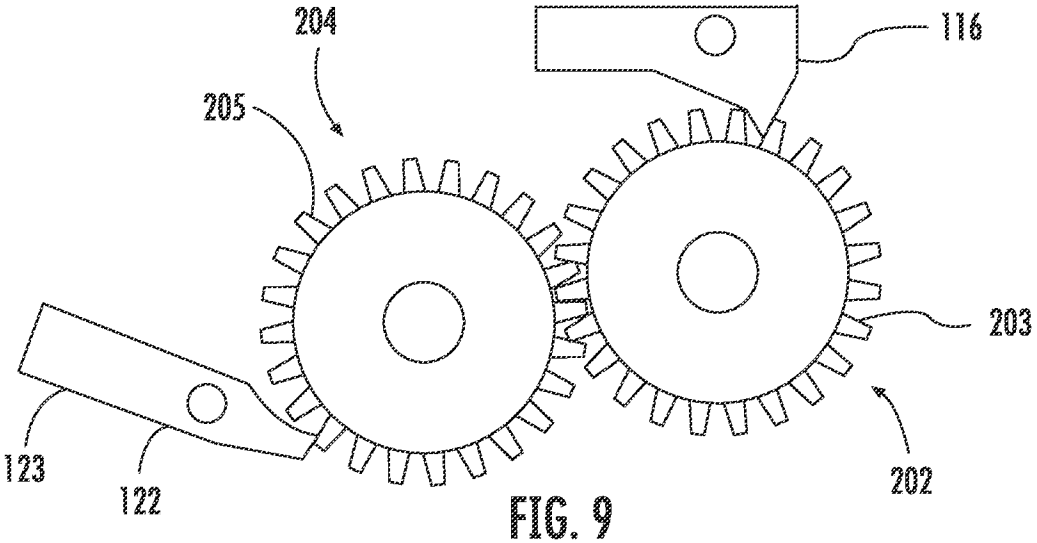
FIG. 9 is a side view of a lug in combination with a drive gear in combination with a spindle gear in combination with a pawl, all according to certain embodiments of the present invention.

Once the strap 600 is adequately positioned, the strap 600 may be tensioned through the application of a force to the lever 104. For example, as illustrated in FIGS. 7-8, the lever 104 may be pulled in a work direction (e.g., clockwise), toward to the support handle 108, thereby engaging the set of gears 200 within the base housing 102, which in turn rotate the spindle 106 in an opposite direction (e.g., counter-clockwise), thereby tensioning the strap 600. More specifically, the lug 116 of the lever 104 engages a tooth 203 of the drive gear 202, rotating the drive gear 202 in the same direction as the lever 104 (e.g., clockwise). Due to the interaction between the teeth 203, 205 of the two gears 200, this rotation effects a counter rotation of the spindle gear 204 (e.g., counter-clockwise), and thereby the spindle shaft 304 and spindle 106 as well. The lever 104 may repeatedly be raised (i.e., reset) and pulled again to effect further tensioning as desired. The raising of the lever 104 shall not affect the tensioning of the strap 600 because the lug 116 of the lever 104 will slide up and over the teeth 203 of the drive gear 202, rather than engage the drive gear 202. During the tensioning process, the spindle 106 will tension the strap 600 and also collect the excess strapping about the spindle 106, as illustrated in FIGS. 7-8.

Unlike existing tensioning methods and devices, the required tensioning force may be applied to the lever 104 in the direction of the strap 600 and load or object (similar to a squeeze). This application of force is more ergonomic than applications of force in a stretching or lifting motion in existing methods and devices, which are directed away from the strap 600 and load or object. The use of the set of gears 200 (two or more), rather than a single gear as in existing methods and devices, may provide for this inverted tensioning force application. One of ordinary skill in the relevant art, however, will understand that other types of apparatuses may be used in combination with the device 100 that provide for such an inverted tensioning.

Additionally, in some embodiments, the tensioning device 100 may be able to be removed from the strap 600 after the tensioning process while avoiding a substantial tension release. In conventional tensioning devices, such substantial tension release is common during removal and may generate a remaining tension value that does not meet minimum standards and/or a load that is too loose for transport. In these embodiments, disengagement of the pawl 122 may enable reversal of the spindle 106 (e.g., clockwise rotation) a few degrees to allow for efficient, controlled removal of the strap 600 from the tensioning device 100. Such efficient, controlled removal may increase the amount of tension remaining on the strap 600 after the tensioning device 100 is removed.

In these embodiments, after desired tensioning is completed, the pawl 122 may be released via the application of a constant, upward force to a distal end 123 of the pawl 122 so as to displace the pawl 122 away from the spindle gear 204, allowing the spindle gear 204, and thereby the spindle 106, to be rotated in a clockwise manner. Specifically, while the lug 116 is engaged with a tooth 203 of the drive gear 202, and the drive gear 202 is simultaneously engaged with the spindle gear 204, the pawl 122 may be released to allow for reversal of the spindle gear 204 and spindle 106 a few degrees by a raising of the lever 104, allowing for efficient, controlled removal of the strap 600 from the tensioning device 100. For example, in the embodiments illustrated in FIGS. 1-8, the pawl 122 may be released to allow for reversal of the spindle gear 204 and spindle 106 a few degrees by a raising of the lever 104 in a counter-clockwise manner, away from the support handle 108.

In accordance with the teachings above, the tensioning device 100 may provide up to 2500 lbs. or more of tension to the strap 600 in certain embodiments, prior to removing the device 100 from the strap 600. In some embodiments, the device 100 may provide up to 1200 lbs. or more of tension to the strap 600 that remains after the device 100 is removed from the strap 600. In these embodiments, the amount of tension remaining on the strap 600 after the device 100 is removed from the strap 600 exceeds all common shipping tension standards and the amount of tension delivered by conventional tensioning devices.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A tensioning device comprising:

(a) a base housing comprising:

(i) a drive gear;

(ii) a spindle gear proximate the drive gear; and (iii) a pawl proximate the spindle gear;

(b) a lever pivotally coupled to the base housing and comprising a lug pivotally coupled to the lever, wherein the lug is configured to interact with the drive gear;

(c) a spindle fixedly coupled to the spindle gear; and (d) a brake assembly coupled to the base housing, wherein, the lug is configured to avoid engagement with the drive gear when the lever is rotated in a first direction;

wherein, the lug is configured to engage the drive gear when the lever is rotated in a second direction to effect rotation of the drive gear in the second direction;

wherein, the drive gear is configured to effect a counter rotation of the spindle gear when the drive gear is rotated in the second direction;

wherein the pawl is configured to limit rotation of the spindle gear absent rotation of the drive gear in the second direction; and wherein, the brake assembly is configured to operate independently from the lever.

2. The tensioning device of claim 1 further comprising a support handle coupled to the base housing.

3. The tensioning device of claim 2 further comprising a guide coupled to the support handle.

4. The tensioning device of claim 1 wherein the brake assembly comprises a biasing mechanism.

5. The tensioning device of claim 1 wherein the brake assembly comprises:

(a) a brake shaft rotatably coupled to the base housing;

b) a body fixedly coupled to the brake shaft;

(c) a brake lever coupled to the body;

(d) a brake plate coupled to the body; and (e) a footer coupled to the base housing.

6. The tensioning device of claim 5 wherein the brake assembly further comprises a coil spring coupled to the brake shaft.

7. The tensioning device of claim 5 wherein the brake plate is pivotally coupled to the body.

8. The tensioning device of claim 7 wherein the brake plate is spring-loaded.

9. The tensioning device of claim 5 wherein the brake plate comprises a textured contact surface.

10. The tensioning device of claim 5 wherein the footer comprises a textured contact surface.

11. The tensioning device of claim 1 wherein the spindle comprises a slot.

12. The tensioning device of claim 1 wherein the lug is spring-loaded.

13. The tensioning device of claim 1 wherein the pawl is capable of being displaced from proximate the spindle gear.

* * * * *